US008882110B2

(12) United States Patent
Jude

(10) Patent No.: US 8,882,110 B2
(45) Date of Patent: Nov. 11, 2014

(54) SHUFFLE BOARD GAME

(76) Inventor: Ioan Jude, Dearborn, MI (US)

( * ) Notice: Subject to any disclaimer, the term of this patent is extended or adjusted under 35 U.S.C. 154(b) by 194 days.

(21) Appl. No.: 12/851,987

(22) Filed: Aug. 6, 2010

(65) Prior Publication Data

US 2011/0031685 A1 Feb. 10, 2011

Related U.S. Application Data

(60) Provisional application No. 61/231,748, filed on Aug. 6, 2009.

(51) Int. Cl.
*A63F 7/00* (2006.01)
*A63F 7/30* (2006.01)

(52) U.S. Cl.
CPC ..... *A63F 7/0005* (2013.01); *A63F 7/305* (2013.01)
USPC ..... 273/126 R; 273/123 R

(58) Field of Classification Search
USPC ..... 273/108.1, 108.5, 119 R, 123 R, 125 A, 273/126 A, 126 R, 127 R
See application file for complete search history.

(56) References Cited

U.S. PATENT DOCUMENTS

| | | | | |
|---|---|---|---|---|
| 1,294,873 | A | | 2/1919 | Canivet |
| 1,468,336 | A | | 9/1923 | Vondersloot |
| 1,506,369 | A | | 8/1924 | Guinan |
| 1,534,522 | A | | 4/1925 | Halliday |
| D90,462 | S | | 8/1933 | Tolman et al. |
| 2,238,703 | A | * | 4/1941 | McIver et al. ..... 273/126 R |
| D159,109 | S | * | 6/1950 | Storey ..... D21/321 |
| 2,601,552 | A | | 6/1952 | Niewinski |
| 2,954,978 | A | * | 10/1960 | Towle, Jr. ..... 273/126 R |
| 3,429,574 | A | | 2/1969 | Williams |
| 4,040,626 | A | | 8/1977 | Sterlicchi et al. |
| 4,076,248 | A | | 2/1978 | Goulet et al. |
| 4,215,863 | A | * | 8/1980 | Kuiper ..... 273/126 R |
| 4,995,611 | A | | 2/1991 | Goldthorpe |
| 5,110,128 | A | * | 5/1992 | Robbins ..... 273/126 A |
| D340,951 | S | | 11/1993 | Howrilka et al. |
| D361,795 | S | * | 8/1995 | Abrudan ..... D21/321 |
| 5,556,093 | A | | 9/1996 | Lankiewicz et al. |
| 5,667,217 | A | | 9/1997 | Kelly et al. |
| 6,095,519 | A | | 8/2000 | Shoemaker, Jr. |
| 6,502,819 | B2 | | 1/2003 | Rieber et al. |

* cited by examiner

*Primary Examiner* — Nini Legesse
(74) *Attorney, Agent, or Firm* — Rader, Fishman & Grauer PLLC

(57) ABSTRACT

A shuffle board game system including a shuffle board game apparatus and a method of playing a game such as shuffle board. The board game includes a base, a pair of side walls, an end wall and an intermediate wall each connecting the side walls and defining therebetween a goal region, a plurality of dividing walls each extending between the end wall and the intermediate wall, a plurality of openings formed in the dividing wall, and a removable cover selectively connectable to the side walls to selectively enclose the goal region. The method of playing a game is applied to game with a plurality of playing pieces launched by a player at a plurality of goals. The method includes the steps of launching playing pieces towards a goal region; re-launching each playing piece that is not in the goal region if all goals contain at least one playing piece; scoring a point for each playing piece not in the goal region; and adding a penalty to the point score if there is any goal which does not contain a playing piece.

16 Claims, 6 Drawing Sheets

SHUFFLE BOARD GAME

CROSS-REFERENCE TO RELATED APPLICATIONS

This application claims priority to U.S. Ser. No. 61/231,748 filed Aug. 6, 2009, which is incorporated herein by reference in its entirety.

BACKGROUND

The present invention is directed to game systems and more particularly to shuffle board game systems including a shuffle board game apparatus and a method of playing a game.

Shuffle board games typically involve an elongated playing field and a plurality of game pieces such as a puck or a chip which may be slid along the surface of the playing field. The elongated playing field has at one end a launching region for a player to launch or shoot a play piece along the length of the playing field. The elongated playing field has at the other end a goal region having one or more goals for the playing piece. The player's score is determined by the placement of playing pieces on appropriate locations in the goal region. The goal region may include a target area having differential point values or one or more individual goals. The playing field and the goal region may be barrier free or may have one or more barriers which may assist or interfere with the players efforts to launch a playing piece into an intended location in the goal area.

Such shuffle board games have been popular for generations and have been made in many different sizes. They may have large playing fields including a launch area where a player may stand to launch a playing piece towards a goal. Alternatively, the playing field may be on an arcade game table or may be on a portable apparatus for home use. Still other shuffle board game systems have utilized electronic systems and a virtual playing field.

The present invention offers a novel shuffle board game system offering improved portability and enjoyment.

SUMMARY

The present invention provides a shuffle board game system including a shuffle board game apparatus and a method of playing a game that may be used with the shuffle board game apparatus.

In one exemplary embodiment, the shuffle board game apparatus is disclosed including a base, a pair of side walls, an end wall and an intermediate wall each connecting the side walls and defining there between a goal region. Dividing walls extend between the end wall and the intermediate wall to divide the goal region into a plurality of goals. A plurality of openings formed in the dividing wall provides access to the goals. A removable cover is selectively connectable to the side walls to enclose the goal region.

In another exemplary embodiment, a method of playing a game such as shuffle board with a plurality of playing pieces launched by a player at a plurality of goals is disclosed. The method includes the steps of launching playing pieces towards a goal region; re-launching each playing piece that is not in the goal region if all goals contain at least one playing piece; scoring a point for each playing piece not in the goal region; and adding a penalty to the point score if there is any goal which does not contain a playing piece.

BRIEF DESCRIPTION OF THE DRAWINGS

In the drawings:

FIG. 3 1 is a top perspective exploded view of the shuffle board game apparatus of FIG. 1 with the cover removed;

DESCRIPTION

Figure 10:
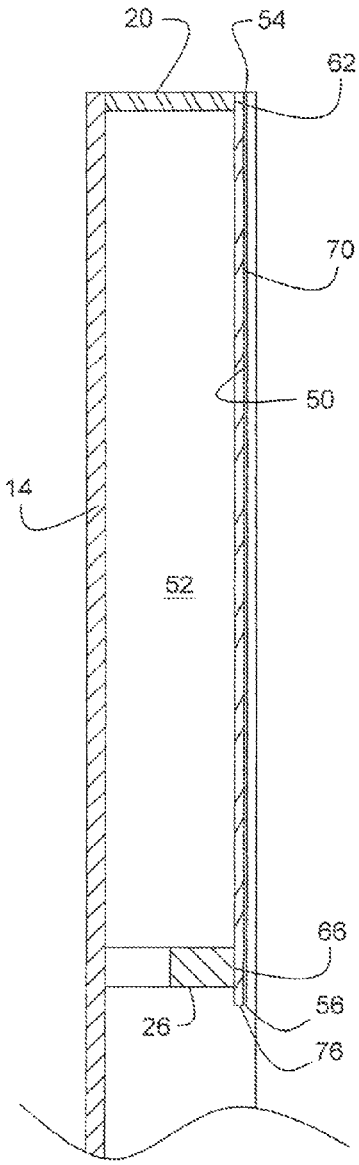
FIG. 10 is a partial sectional view similar to FIG. 9 illustrating the inside surface of one side wall of the shuffle board game apparatus of FIG. 1 with a cover attached.
Figure 11:
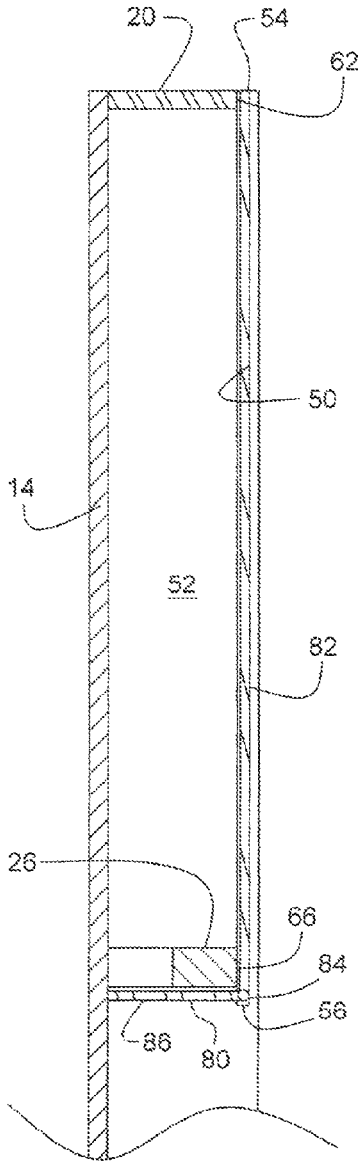
FIG. 11 is a partial sectional view similar to FIG. 9 illustrating the inside surface of one side wall of the shuffle board game apparatus of FIG. 1 with the alternative cover of FIGS. 4-6 attached.
Figure 12:
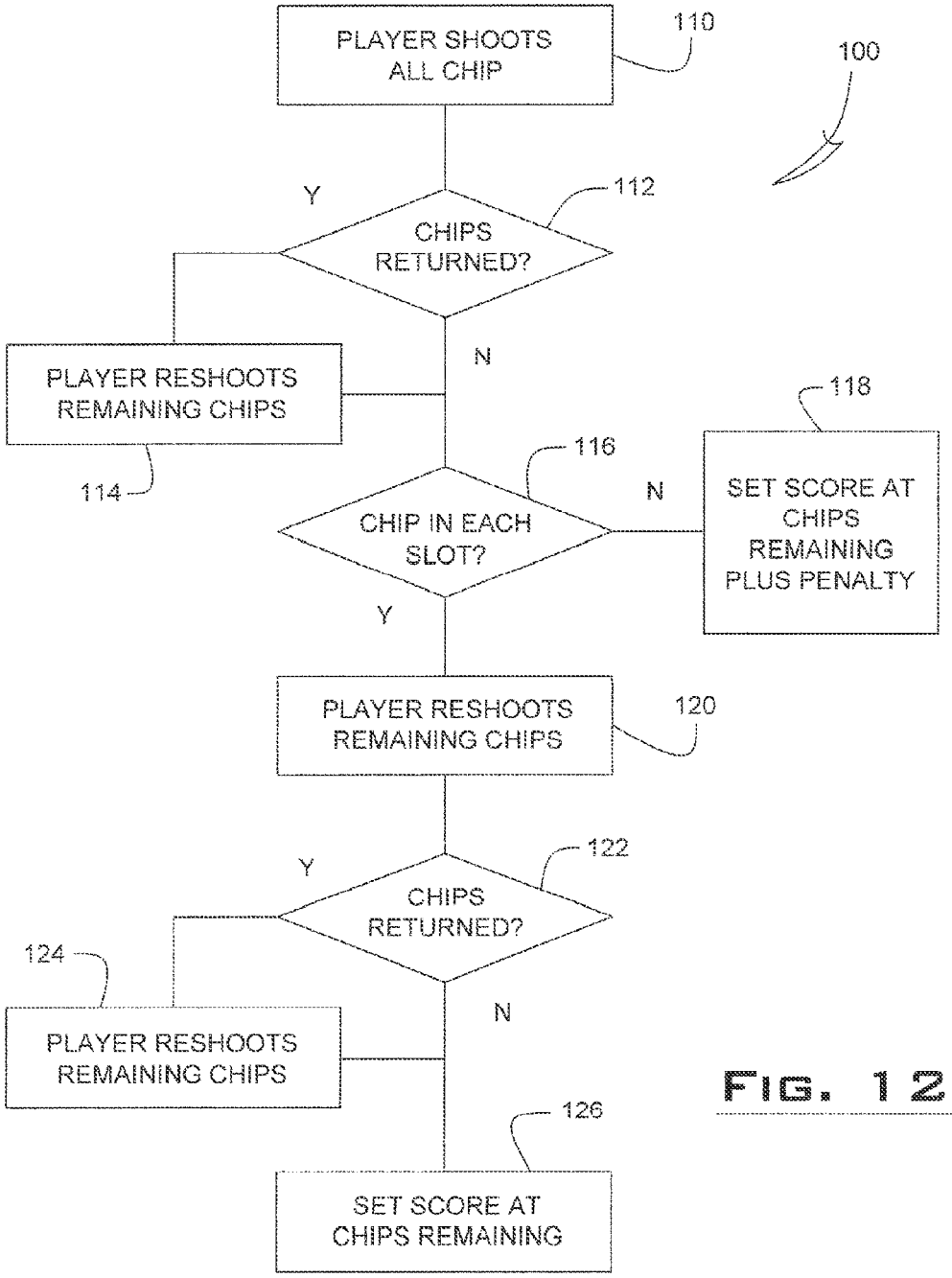
FIG. 12 and a flow chart illustrating a method of using the shuffleboard of FIGS. 1-5.

An exemplary shuffle board game system including an exemplary shuffle board game apparatus 10 is illustrated in FIGS. 1-11 and an exemplary game playing method 100 is illustrated in FIG. 12. In the discussion that follows and also to the drawings, illustrative approaches to the disclosed systems and methods are shown in detail. Although the drawings represent possible approaches, the drawings are not necessarily to scale and certain features may be exaggerated, removed, or partially sectioned to better illustrate and explain the present invention. Further, the descriptions set forth herein are not intended to be exhaustive or otherwise limit or restrict the claims to the precise forms and configurations shown in the drawings and disclosed in the following detailed description.

FIGS. 1-6 depicting certain details of exemplary shuffle board game apparatus 10. Shuffle board games are typically played with playing pieces that are scaled for the size of the apparatus. The exemplary shuffle board game apparatus 10 is a portable table top unit and the playing pieces are chips 12, shown in FIGS. 1-4, of one inch diameter or less. Chips 12 may formed of plastic, metal, ceramic, wood or other suitable material depending on such factors as cost, durability, weight and appearance.

Chips 12 may be solid colored, transparent or translucent or provided with ornamentation such as patterns, letters, numbers, logos, words, icons, or pictures. The ornamentation may include advertising. All of the chips 12 may be identical in size, color and shape or they may be varied for specific purposes. For example, chips 12 may be varied in size for different skill levels of players. Chips 12 may be varied in color or decoration for ornamental purposes. Chips 12 may be varied in ornamentation to distinguish between chips for purposes of providing differential scoring values or for other purposes relating to the official rules of the game play or a method used by players for game play. Chips 12 may be varied in ornamentation to provide each player with uniquely decorated chips that may be identified with the player during game play.

Figure 1:
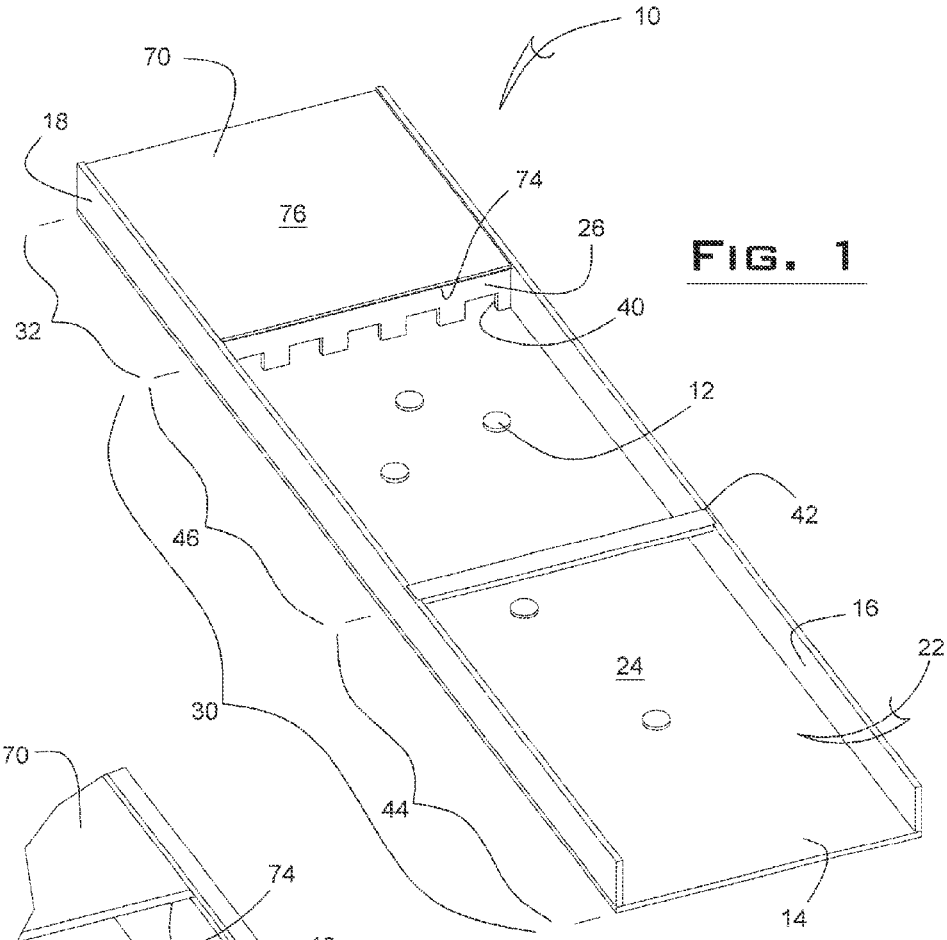
FIG. 1 is a top perspective view of a shuffle board game apparatus with a cover attached.
Figure 2:
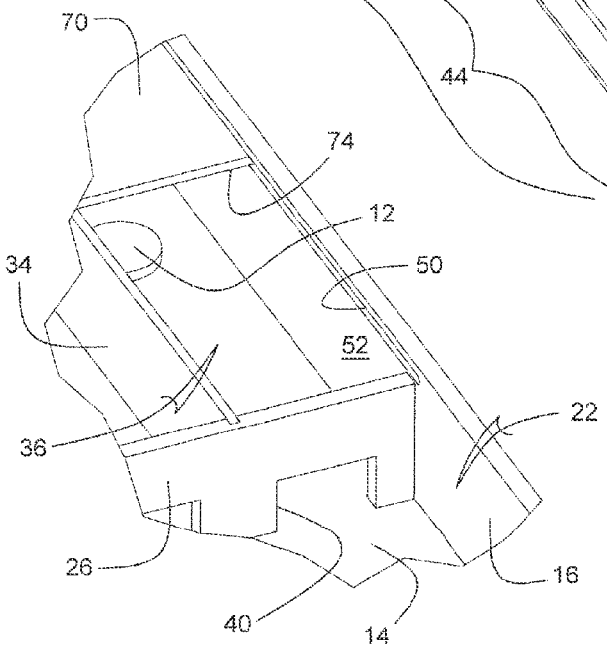
FIG. 2 is an enlarged partial perspective view of a portion of the shuffle board game apparatus of FIG. 1 with the cover partially attached.
Figure 3:
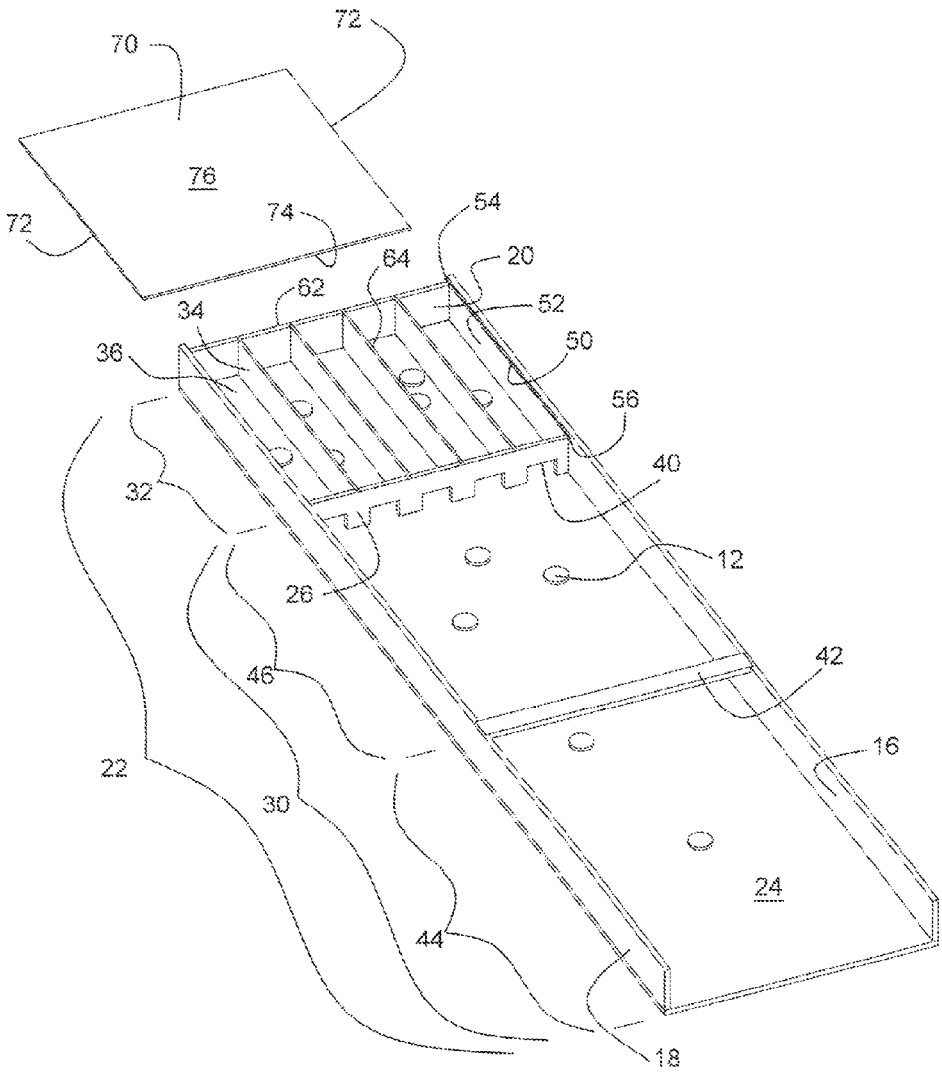

As shown generally in FIGS. 1-6 but best shown in FIG. 3, Shuffle board game apparatus 10 includes a flat elongated rectangular base 14. A pair of elongated spaced apart parallel side walls 16 and 18 is fastened to base 14 and extend upwardly therefrom. An end wall 20 is fastened to one end of base 14 and extends upwardly therefrom and extends between side walls 16 and 18. Together, base 14 and walls 16, 18 and 20 define an elongated game field 22 for playing shuffle board. The upper surface of base 14 provides playing surface 24 for playing field 22 on which chips 12 may be slid for game play.

An intermediate wall 26 extends upwardly from base 14 and extends between side walls 16 and 18 at an intermediate location in game field 22. Intermediate wall 26 is parallel to end wall 20 and divides game field 22 into a goal region between end wall 20 and intermediate wall 26 and a play region beyond intermediate wall 26.

One or more dividing walls 34 extend upwardly from base 14 and extend between end wall 20 and intermediate wall 26. Dividing walls 34 are parallel to side walls 16 and 18 and divide the goal region 32 into elongated compartments or goals 36. In the exemplary shuffle board game apparatus 10 illustrated, there are four elongated compartments or goals 36. A different number of goals 36 may be provided depending on such considerations as the desired complexity and cost of shuffle board game apparatus 10. An opening 40 is provided through intermediate wall 26 into each goal 36 for sliding passage therethrough of chips 12. Openings 40 are wider than the diameter of chips 12 by a small amount so as to selectively admit chips 12 therethrough during game play. The comparative total width of openings 40 relative to the total width of intermediate wall 26 determines the relative difficulty of getting a chip to pass from the play region 30 to a goal 36 and may therefore be designed to provide a desired overall level of difficulty for the exemplary shuffle board game apparatus 10.

A brace 42 extends across and intermediate portion of play region 30 between side walls 16 and 18. Brace 42 is spaced away from the play surface 24 of play region 30 by more than the thickness of chips 12 so as to permit the sliding passage of chips 12 thereunder during game play. Brace 42 contributes to the overall rigidity of shuffle board game apparatus 10. Brace 42 also may be used to partition play region 30 into a non-launching area 46 between brace 42 and intermediate wall 26 where players are not permitted to launch or shoot chips 12, and a launching region 44 from which players may launch or shoot chips 12. Brace 42 therefore effectively defines a starting line for a player to utilize during game play as well as physical reminder that a player must release a chip 12 no further along the playing surface when launching or shooting a chip 12 towards the goal region 32. Brace 42 may also serve as a fixture to secure the game to a wall after playing.

It should be noted that the various components of the shuffle board game apparatus 10, including base 14, walls 16, 18, 20, 26 and 34 and brace 42 may be constructed of wood, metal, plastic or any other suitable material depending on such factors as cost, durability, weight, surface characteristics and appearance. These components may be solid colored, transparent or translucent or provided with ornamentation such as patterns, letters, numbers, logos, words, icons, or pictures. The ornamentation may include advertising. Such ornamentation may be for decorative or advertising purposes. Alternatively, such ornamentation may be for a functional purpose such as providing rules, communicating reference points for aiming chips 12, or to define regions or goals for differential scoring values or for other purposes relating to the official rules of the game play or a method used by players for game play, either alone or when used in combination with ornamentation on chips 12. For example, one or more goal 36 may be provided with ornamentation matching ornamentation on one or more chips 12 to permit rules or a method of play that provides a bonus or a penalty when a chip 12 enters a goal 36 with matching or related ornamentation. The starting line function of brace 42 may be supplemented by a starting line printed on playing surface 24 directly below brace 42.

Figure 4:
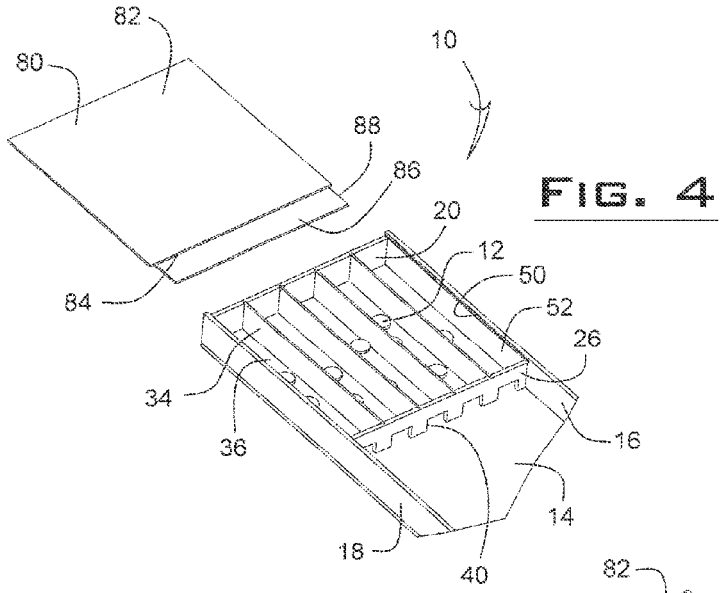
FIG. 4 is a partial perspective exploded view of the shuffle board game apparatus of FIG. 1 with an alternate cover positioned for installation.
Figure 5:
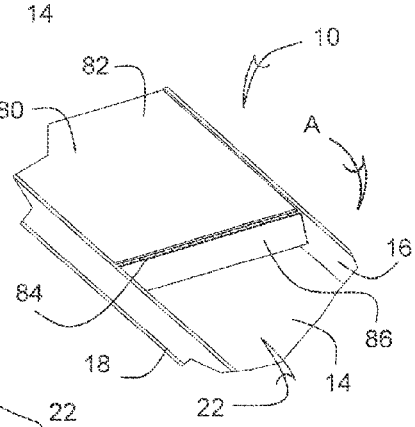
FIG. 5 is an partial perspective view of a portion of the shuffle board game apparatus of FIG. 1 with the alternative cover partially installed.
Figure 6:
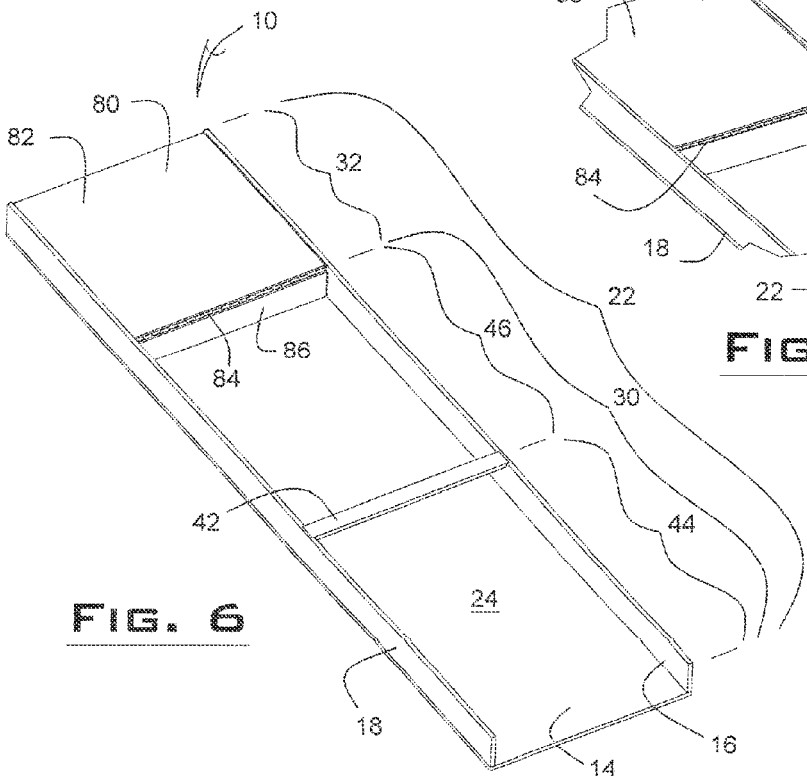
FIG. 6 is an perspective view of a portion of the shuffle board game apparatus of FIG. 1 with the alternative cover fully installed.
Figure 7:
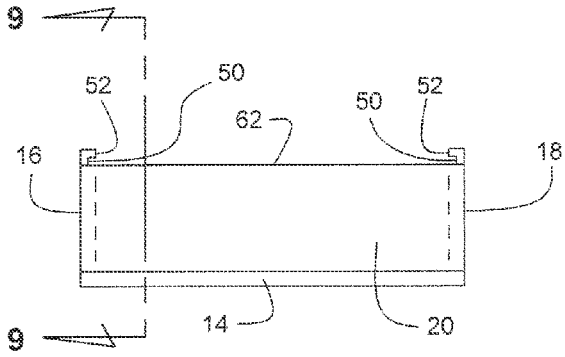
FIG. 7 is a rear elevation view of the shuffle board game apparatus of FIG. 1 with the cover removed.

As generally shown in FIGS. 2 and 4 but best shown in FIGS. 8-11, each side wall 16 and 18 is provided with a channel 50 on an inner surface 52 thereof facing into game field 22 and located generally above goal region 32. Channels 50 are coplanar and define a plane generally parallel to play surface 24. Each channel 50 may comprise a slot formed in a side wall 16 or 18 or may be a separate rail component, not shown, or one or more elongated abutments, not shown, attached to a side wall 16 or 18. Each channel 50 has an open end or entry end 54 located near end wall 20 and a closed end or terminal end located near intermediate wall 26.

Channels 50 are disposed above the upper edge 62 of end wall 20 and above the upper edges of divider walls 34. Channel 50 may be disposed above the upper edge of intermediate wall 26, depending on the type of cover, described shortly herein, being used.

Figure 8:
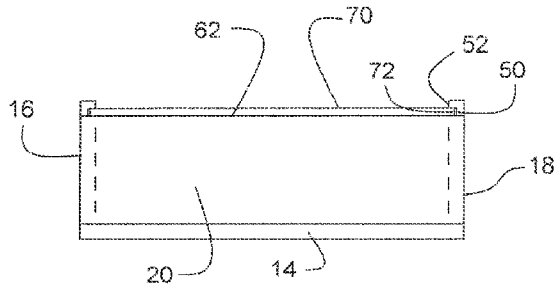
FIG. 8 is a rear elevation view of the shuffle board game apparatus of FIG. 1 with the cover attached.
Figure 9:
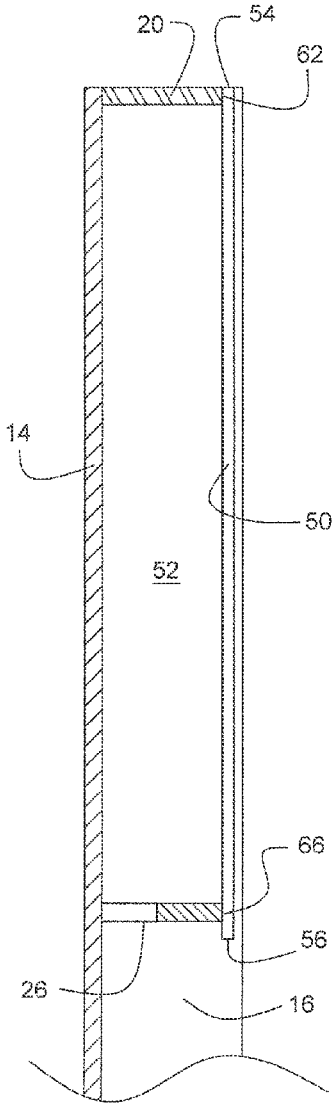
FIG. 9 is a partial sectional view taken along line 9-9 of FIG. 7 illustrating an inside surface of one side wall of the shuffle board game apparatus of FIG. 1 with the cover removed.

As shown generally in FIGS. 1 and 3 and in more detail in FIGS. 8 and 10, shuffle board game apparatus 10 may be provided with a cover 70 to selectively cover goal region 32. As best shown in FIG. 3, cover 70 may comprise a rectangular plate having opposing side edges 72 selectively insertable into channels 50. In particular, cover 70 may be installed by inserting side edges 72 into entry ends 54 of channels 50 and sliding cover 70 along channels 50 to cover goal region 32 as shown in FIGS. 2, 8 and 10. If upper edge 66 of intermediate wall 26 is below the plane of channels 50, then cover 70 may be slid along channels 50 until the leading edge 74 of cover 50 abuts the terminal end of channels 50, the as shown in FIG. 10. Alternatively, and not shown in the drawing, if upper edge 66 of intermediate wall 26 extends above the plane of channels 50, then cover 70 may be slid along channels 50 until the leading edge 74 of cover 50 abuts intermediate wall 26. In either event, cover 70 closes the top of goal region 32 when installed to inhibit the removal of chips 12 therefrom when the shuffle board game apparatus 10 is moved.

As shown generally in FIGS. 4-6 and 11, shuffle board game apparatus 10 may be provided with a cover 80 to selectively cover goal region 32 and openings 40 in intermediate wall 26. As best shown in FIG. 4, cover 80 may comprise a rectangular plate 82 similar to cover 70 and insertable into channels 50 in a manner similar to cover 70. Cover 80 is further provided with a flap 86 hingedly connected to leading edge 84 of plate 82. Flap 84 is proportioned to be capable of covering openings 40 of intermediate wall 26, but is slightly narrower than plate 82, as shown at 88 in FIG. 4, such that, when plate 22 is installed in channels 50, flap 26 is free of channels 50. Therefore, when plate 82 of cover 80 is slid along channels 50 into position over goal region 32, flap is free to pivot downwardly into position over intermediate wall 26 as shown in FIG. 11. It will be appreciated that, if cover 80 is used upper edge 66 of intermediate wall 26 may not extend above the plane defined by channels 50. Flap 86 may be held in position over openings 40 by cooperating mechanical or magnetic attachment components, not shown, in flap 44 and intermediate wall 26. Alternatively, cover 89 may be designed to provide a biasing force between plate 82 and flap 86 to bias flap 86 against intermediate wall 26. Cover 80 thereby closes the top of goal region 32, including openings 40, when installed to inhibit the removal of chips 12 therefrom when the game apparatus 10 is moved.

It will be appreciated that, depending on the dimensions of divider walls 34, cover 70 and 80 may also inhibit or prevent the movement of chips 12 between the different goals 36 during transport. In addition, walls 20, 16 and 34 or covers 70 or 80 may be provide with additional features or components to provided additional sealing functionality. Covers 70 or 80 may be also provided with a handle to facilitate installation or removal.

Covers 70 and 80 may be constructed of wood, metal, plastic or any other suitable material depending on such factors as cost, durability, weight, surface characteristics and appearance. For example, cover 80 may be formed as a unitary of resilient material, with a hinged portion created by a thin region at leading edge 84 of plate 82. These components may be solid colored, transparent or translucent or provided with ornamentation such as patterns, letters, numbers, logos, words, icons, or pictures. For example, cover 70 may be transparent to permit a player to view the contents of each goal 36 and thereby use cover 36 during game play. A cover 70 or 80 may include advertising ornamentation, game rules or decorative ornamentation. A cover 70 or 80 may be reversible and provide different ornamentation depending on which surface is exposed when installed.

Referring to FIG. 3, shuffle board game apparatus 10 is used by a player placing a chip 12 on game surface 24 in launching region 44 and manually launching or shooting the chip towards a goal, by manually sliding chip 12 towards goal region 32 and releasing chip 12 before encountering brace 42.

Shuffle board game apparatus 10 may be inexpensively mass produced in a home version for personal enjoyment, family leisure, and for friendly and quality time by people from all cultures and walks of life. Alternatively, it may be manufactured from prestige and durable materials for more upscale users. It may be manufactured in a heavier and more rugged version for use in bars, arcades and other commercial settings. It may be manufactured or ornamented in limited collector editions incorporating on its various surfaces advertisement, information, logos, family portraits, sports images, movie stars, famous places, outer space, flags of different clubs or nations, or sports teams. Thus, shuffle board game apparatus 10 may be enjoyed by one or more people in the privacy of their homes, on ocean liners, or at armed force club, Boys and Girls clubs, resorts, bars, arcades or senior citizen housing. It is intended to be challenging and competitive.

An exemplary game playing method 100 is depicted in FIG. 12 and will now be described. It should be noted that game playing method 100 may be used for any game where a plurality of play pieces are launched towards a plurality of goals. The playing pieces may be any projectile than may launched at a goal and the goals may be any goals that are suitable for the type of projectile used.

Game playing method 100 begins in step 110 by a player sequentially launching each of a plurality of play pieces towards a plurality of goals. In the case of exemplary shuffle board game apparatus 10, then, a player sequentially launches or shoots each of thirty chips 12 towards goal region 32 in an attempt to get each chip 12 into a goal 36. It will further be appreciated that game playing method 100 may be applied to a virtual game such as an electronic game of shuffle board.

Next, in step 112, game playing method 100 determines if playing pieces have been returned. In the case of exemplary shuffle board game apparatus 10, the method determined if any chips 12 have rebounded off of intermediate wall 26 and passed brace 42 into launching region 44. If any playing pieces or chips 12 have been returned, then in step 114, the player gets an opportunity to re-launch or reshoot returning chips 12 before method 100 advances to step 116. If no playing pieces or chips 12 have been returned, then method 100 advances directly to step 116.

In step 116, game playing method 100 determines if every goal 36 has been hit or entered by at least one playing piece or chip 12. If any goal 36 does not contain a playing piece or chip 12, then in step 118, the player's score is set at the number of chips remaining plus a penalty, such as 30 points, and the player's turn ends, terminating method 100. If all goals 36 contain a playing piece or chip 12, then method 100 advances to step 120.

In step the player re-launches or reshoots any playing pieces or chips 12 which have not entered a goal 36. In the case of the exemplary shuffle board game apparatus 10, the player reshoots all chips that are now found in the non-launch region 46.

Next, in step 122, the method again determines if any play pieces or chips 12 have been returned, in which case, in step 124, the player may reshoot the returned play pieces or chips 12 before the method advances to step 126. If no play pieces or chips 12 have been returned, the method advances directly to step 126.

In step 126, the player's score is set at the number of chips 12 which are still not in a goal 36. After step 126, the player's turn ends and method 100 terminates.

Game playing method 100 comprises a single turn for a single player. A game may consist of a single player playing one or more turns and accumulating a total score for all of the games. A game may comprise of one round of two or more players sequentially taking turns applying method 100 and comparing scores, with the winner being the player with the lowest score. A game may comprise two or more rounds played by two or more players, with each round consisting of each player having a turn applying method 100, with the winner being the player with the lowest total of scores from their turns. Alternatively, a game may comprise two or more players each simultaneously applying method 100 by a players taking a turn making one or more shots, then the next player taking a turn making one or more shots, and continuing until all players have made all of their shots and reshots. In this last example, the chips used by each player must have ornamentation to identify the chip with its player.

The above detailed description of exemplary game apparatus 10 and exemplary game playing method 100 together provides a shuffle board game system that can be played by one or more people four years of age and older. As described, each player has a chance to slide approximately thirty chips 12 through a one inch opening 40 in intermediate wall 26 into a goal 36. To play the game, players use their fingers to slide each of the thirty chips on the base of the shuffle board in an attempt to score or place a chip 12 within each of the five goals 36. Each opening 40 for each t is slightly larger than the diameter of the chips 12. A player has the right to reuse any chips 12 if by any chance one of the chips bounce back passing the starting line defined by brace 42. Each player will have two chances to slide as many chips 12 as they can across the game surface 24 into the openings 40. The player must place at least one chip 12 through each of the five openings 40 in their first try using the thirty chips 12 they are provided. If the player is able to place one or more chips 12 through each of the openings 40, they will have the opportunity to improve their score by trying once more to slide the remainder of the thirty chips 12 that did not go through the openings 40 the first time.

If a player does not get a chip 12 into each of the five openings 40, on their first try, they will add a penalty of thirty points to their score for not placing chips through all five openings 40 on the first try. If the player is not able to place at least one chip 12 through each opening 40 from their first try they will also lose their second chance. After the second try, each player will count the chips 12 that they were not able to slide into the openings. The player with the fewest number of chips left out of the openings will be the winner.

It will be appreciated that while the game playing method 100 is illustrated as having steps 110-126, it may alternatively or additionally include further steps including further decision making steps that may sometimes bypass one or more of steps 110-126. Such additional decision making steps may be triggered by the ornamentation on a chip 12, on playing surface 24, for example. Such additional steps may include steps involving additional scoring penalties or rewards, as well as additional opportunities to reshoot or loss of shooting opportunities. It will also be appreciated that the steps of method 100 may be varied from an early round of a game to a later round of a game.

In general with regard to the processes, systems, methods, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

It is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All defined terms used in the claims are intended to be given their broadest reasonable constructions consistent with the definitions provided herein. All undefined terms used in the claims are intended to be given their broadest reasonable constructions consistent with their ordinary meanings as understood by those skilled in the art unless an explicit indication to the contrary is made herein. In particular, use of the singular articles such as "a," "the," "said," etc. should be read to recite one or more of the indicated elements unless a claim recites an explicit limitation to the contrary.

The invention claimed is:

1. A shuffle board comprising:

a base;

a pair of side walls;

an end wall connecting the side walls of the base and defining a game field;

an intermediate wall extending between the side walls and dividing the game field into a play region and a goal region;

a plurality of dividing walls each extending between the end wall and the intermediate wall and dividing the goal region into a plurality of elongated goals, each of said goals having a width greater than the diameter of the chips;

a plurality of openings formed in the dividing wall, each opening having a width greater than the diameter of the chips and providing an opening for selective passage of a chip between the play region and the goal region; and a removable cover, the cover including a first closure proportioned for covering a top of the goal region and a second closure for closing the openings.

2. The shuffle board as claimed in claim 1, further comprising said plurality of chips.

3. The shuffle board as claimed in claim 1, wherein the inner surfaces of each of said side walls has a channel generally parallel to the base and further wherein said cover comprises a rectangular plate having opposing edges engageable with said channels whereby said cover is removably attached to said sidewalls to enclose said goal region by being slid along the channels into a position over the goal region.

4. The shuffle board as claimed in claim 3, wherein each channel comprises an opening adjacent the end wall for admission of the cover to the channel.

5. The shuffle board as claimed in claim 3, wherein each of the channels has a bottom edge and further wherein the top of the end wall is generally coplanar with the bottom edge of each of the channels.

6. The shuffle board as claimed in claim 3, wherein each of the channels has a bottom edge and further wherein the top of the intermediate wall is generally coplanar with the bottom edge of each of the channels.

7. The shuffle board as claimed in claim 3, wherein each of the channels has a bottom edge and further wherein the top of each divider wall is generally coplanar with the bottom edge of each of the channels.

8. The shuffle board as claimed in claim 3, wherein the cover further comprises a flap hingedly connected to the plate, said flap being proportioned to selectively cover the channels when the plate is positioned for covering the top of the goal.

9. The shuffle board as claimed in claim 1, wherein the second closure is hingedly attached to the first closure.

10. The shuffle board as claimed in claim 1, further comprising game instructions.

11. The shuffle board as claimed in claim 1, further comprising a brace extending between the side walls and spaced from the base by at least the height of the chips, the brace dividing the play area into a launching area and a non-launching area.

12. The shuffle board as claimed in claim 11, wherein the brace provides structural rigidity to the shuffle board.

13. A shuffle board comprising for use in conjunction with a plurality of chips;

a base;

a pair of side walls extending upwardly from the base;

an end wall connecting the side walls of the base and defining a game field therebetween;

an intermediate wall extending between the side walls and dividing the game field into a play region and a goal region;

a pair of spaced coplanar channels formed in each of the side walls and opening into the goal region, each of the channels being disposed generally parallel to and spaced away from the base at a height above the top of the end wall;

a plurality of openings formed in the dividing wall, each opening having a width greater than the diameter of the chips and providing an opening for selective passage of a chip between the play region and the goal region;

a plurality of dividing walls each extending between the end wall and the intermediate wall and dividing the goal region into a plurality of elongated goals, each of said goals having a width greater than the diameter of the chips and extending upwardly from the base to a height below the channels; and a removable cover comprising a rectangular plate having opposing edges selectively engageable with said channels to cooperate with the side walls, end wall and intermediate wall to enclose the goal region, said removable cover further comprising a flap hingedly connected to the rectangular plate to selectively cover the openings.

14. The shuffle board as claimed in claim 13, wherein each of the channels has a bottom edge and further wherein the top of the intermediate wall is generally below the bottom edge of the channels.

15. The shuffle board as claimed in claim 13, further comprising a brace extending between the end walls and spaced from the base by at least the height of the chips, the brace dividing the play area into a launching area and a non-launching area.

16. A shuffle board comprising:

a base;

a pair of side walls;

an end wall connecting the side walls and defining a game field;

an intermediate wall extending between the side walls and dividing the game field into a play region and a goal region;

a plurality of dividing walls each extending between the end wall and the intermediate wall and dividing the goal region into a plurality of elongated goals;

a plurality of openings formed in the dividing wall, each opening having a width greater than the diameter of the chips and providing an opening for selective passage of a chip between the play region and the goal region; and a removable cover having a first portion and a second portion, the first portion covers the goal region and the second portion covers the openings, the portions are hinged to one another.

* * * * *